US008418781B2

(12) United States Patent
Chambers et al.

(10) Patent No.: US 8,418,781 B2
(45) Date of Patent: Apr. 16, 2013

(54) PNEUMATICALLY POWERED IMPACT DEVICE AND METHOD

(75) Inventors: Scott E. Chambers, Chesapeake, VA (US); Rick Rahim, Great Falls, VA (US)

(73) Assignee: Rapid Entry Solutions, LLC, Great Falls, VA (US)

( * ) Notice: Subject to any disclaimer, the term of this patent is extended or adjusted under 35 U.S.C. 154(b) by 328 days.

(21) Appl. No.: 12/698,452

(22) Filed: Feb. 2, 2010

(65) Prior Publication Data

US 2011/0186321 A1 Aug. 4, 2011

(51) Int. Cl.
*A62B 3/00* (2006.01)

(52) U.S. Cl.
USPC ..... 173/200; 227/130; 227/136

(58) Field of Classification Search ..... 173/1, 200; 227/130, 136
See application file for complete search history.

(56) References Cited

U.S. PATENT DOCUMENTS 3,563,439 A * 2/1971 Pomeroy ..... 227/8
3,670,942 A * 6/1972 Pomeroy ..... 227/10
3,689,104 A * 9/1972 Graham ..... 280/751
3,690,536 A * 9/1972 Bakoledis ..... 227/10
3,897,060 A * 7/1975 Jennings ..... 473/441
3,921,614 A * 11/1975 Fogelgren ..... 124/75
4,282,796 A * 8/1981 Stoner et al. ..... 89/198
4,783,053 A * 11/1988 Yirmiyahu et al. ..... 254/93 R
4,804,127 A * 2/1989 Kirkman ..... 227/10
4,871,034 A * 10/1989 Schmidt ..... 173/90
5,167,043 A * 12/1992 Lopez et al. ..... 7/144
5,329,685 A * 7/1994 Gillespie ..... 29/254
5,415,241 A * 5/1995 Ruffu et al. ..... 173/212
5,517,740 A * 5/1996 Costlow et al. ..... 29/254
5,769,394 A * 6/1998 Yirmiyahu et al. ..... 254/93 R
5,987,723 A * 11/1999 McNally et al. ..... 29/254
6,786,379 B2 * 9/2004 Largo ..... 227/10
7,452,294 B2 * 11/2008 Milone ..... 473/441
7,490,813 B1 * 2/2009 Weddle ..... 254/93 R
2009/0145513 A1 * 6/2009 McKee ..... 141/20
2009/0199613 A1 * 8/2009 Krumrei ..... 72/446
2010/0077585 A1 * 4/2010 Prine et al. ..... 29/252
2011/0203090 A1 * 8/2011 Burt ..... 29/254

* cited by examiner

*Primary Examiner* — Brian D Nash
(74) *Attorney, Agent, or Firm* — Williams Mullen P.C.; Thomas F. Bergert

(57) ABSTRACT

A pneumatic impact device and method provide a high powered striking force against a target object. The device includes a core shell that houses a piston sub-assembly and a sear arm sub-assembly, and that further defines a forward gas chamber and a rearward gas chamber. The rearward gas chamber is loaded with compressed fluid via a handle actuator. A mostly external sear trigger assembly responds to the impact of a striker plate against the target object, thereby releasing a sear arm that then releases a piston, which is then accelerated forward by the compressed fluid charge. The device can be re-set manually via compressed fluid (e.g., air) in one embodiment, or automatically via a spring mechanism in another embodiment.

18 Claims, 8 Drawing Sheets

PNEUMATICALLY POWERED IMPACT DEVICE AND METHOD

FIELD OF THE INVENTION

The present invention relates to hand-held impact devices, and more particularly to a pneumatic hand-held impact device capable of use as a door breaching tool, and associated method.

BACKGROUND OF THE INVENTION

Battering rams are used by firefighters and police officers in order to quickly gain access through locked or barricaded doorways in buildings. Past battering rams are described, for example, in U.S. Pat. No. 5,329,685 to Gillespie. Battering rams generally suffer from being too heavy to operate and failing to provide enough power to break open a door on the first shot.

Pneumatic devices, such as the device described in the Gillespie patent, can provide a higher striking velocity and thus a higher peak force that assists in breaking through a door on the first swing. However, such designs suffer from several disadvantages. First, the supply of compressed air is located internally and is therefore not rapidly interchangeable. Second, the sear mechanisms are generally unstable and of poor mechanics. Third, the venting and charging of gases in Gillespie is not easily managed by the end user, which can result in delays in re-charging or re-setting the device that can translate into negative consequences for the user.

SUMMARY OF THE INVENTION

The present invention provides an improved pneumatic impact device and method. The present invention includes a striking surface forward end, and a rearward end, separated by a housing having multiple compartments that assist in loading and unloading the pressurized fluid. It will be understood that the term "fluid" can mean liquid or gas depending upon pressure and temperature. The present invention contemplates that various types of fluids may be employed, even though the description herein may be described in terms of using a pressurized gas such as compressed air. The triggering sub-system of the present invention is mechanically actuated and includes an extension spring. In one embodiment of the present invention, the pressurization sub-system includes a single valve for charging and a single valve for resetting the device. The piston sub-system is contained between front and rear bulkheads, with no intermediate bulkhead required. This provides a dual-chambered device as opposed to a tri-chamber device as in Gillespie.

To operate the device of the present invention to knock down a barricade such as a door, for example, the rear handle operator is lifted to allow a portion of the compressed fluid (e.g., air) to be released from the container into the charge cavity. The impact device is then swung at the barricade such that the striker assembly hits the barricade, which causes the rod to be pushed against the sear block, thereby raising the sear arm so as to release the piston. The piston then releases through the object-striking end of the impact device. As a result, the piston head hits the barricade with an effectively high striking velocity, thereby imparting a higher peak force for exploding through the barricade. The device of the present invention can be quickly re-set, automatically or manually, in order to permit multiple subsequent strikes against the target object as necessary.

DETAILED DESCRIPTION OF THE PREFERRED EMBODIMENTS

Figure 1:
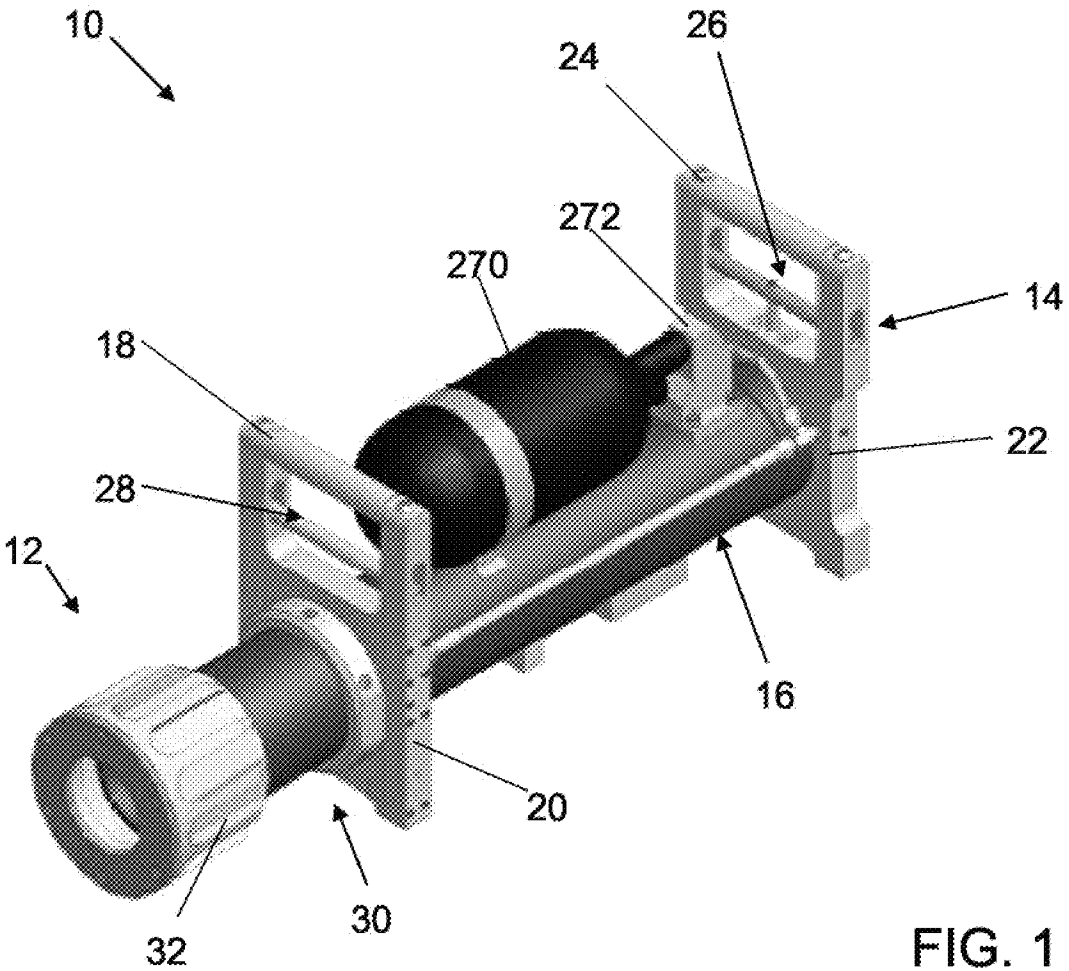
FIG. 1 is an upper right front perspective view of one embodiment of the device of the present invention.

As shown in FIG. 1, there is provided a hand-held impact device 10 in accordance with one embodiment of the present invention. The device 10 includes a front end 12 and a rear end 14 with a substantially cylindrical-shaped core section 16. Front main block 20 is positioned axially inwardly along the core 16 from the front end 12, and includes a front handle 18. Rear main block 22 is positioned at or near the rear end 14 of the device, and includes a rear handle 24. A rear charge valve handle 26 and a front charge valve handle 28 are also shown. The front end includes a striker sub-assembly 30 having a striker head 32.

Figure 2:
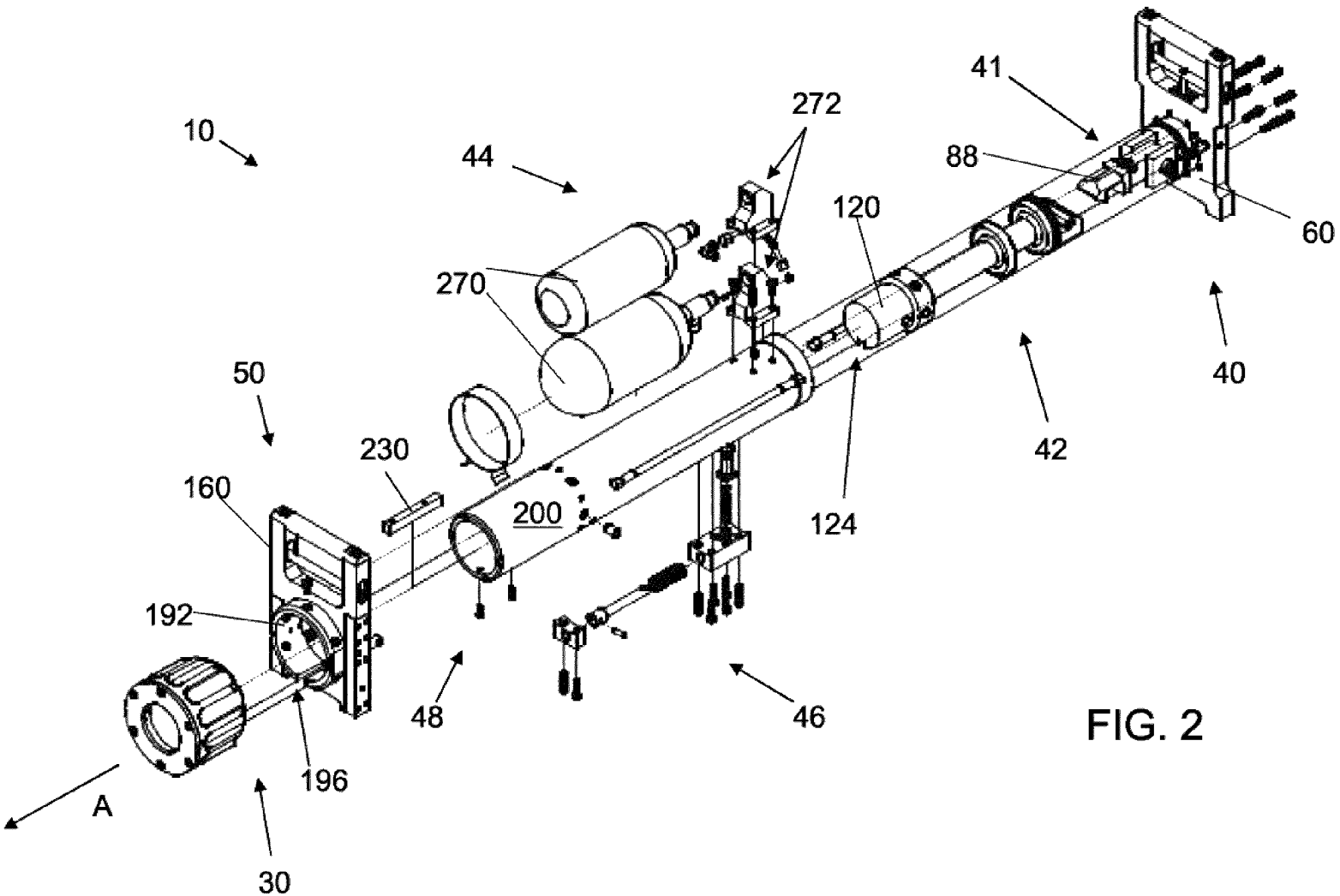
FIG. 2 is an exploded perspective view of one embodiment of the device of the present invention.

As shown in FIG. 2, several sub-assemblies combine to form the displayed embodiment of the device 10 of the present invention, including rear block sub-assembly 40, sear arm sub-assembly 41, piston sub-assembly 42, pressurization sub-assembly 44, sear trigger sub-assembly 46, core sub-assembly 48, front block sub-assembly 50 and striker sub-assembly 30.

Figure 3:
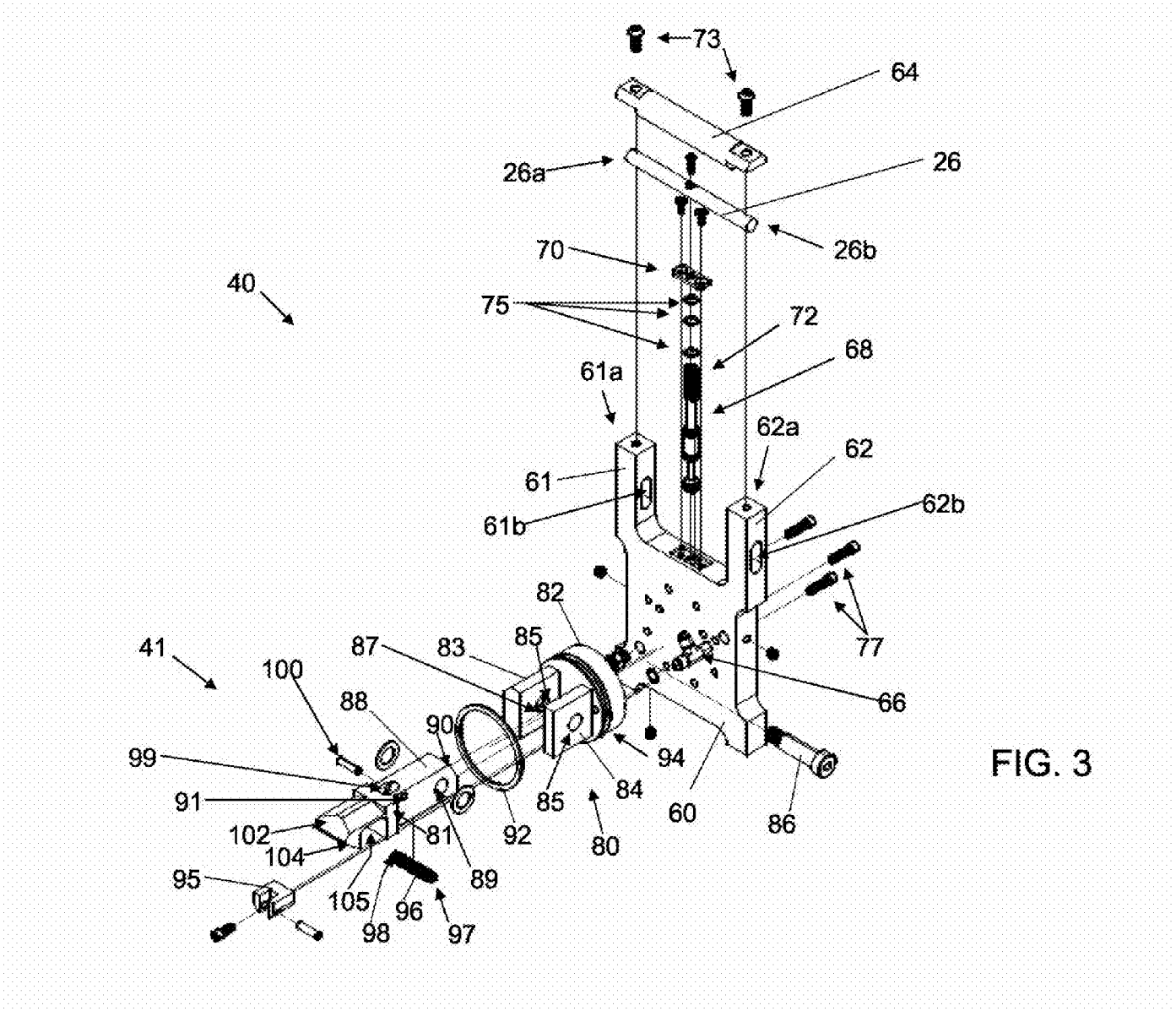
FIG. 3 is an exploded perspective view of a rear block sub-assembly of one embodiment of the present invention.

As shown in FIG. 3, the rear block sub-assembly 40 includes main rear block 60, which has two arms 61 and 62 extending therefrom. Operator handle 64 is secured at the top edges 61*a*, 62*a*, respectively, of the two arms 61, 62. Each of the two arms 61, 62 also includes a respective opening 61*b*, 62*b* extending laterally therethrough for receiving a respective end 26*a*, 26*b* of a charge valve handle 26, so as to permit the charge valve handle ends 26*a*, 26*b* to move vertically within a limited range. The charge valve handle 26 engages a spring-loaded charge valve piston 68, wherein the piston extends into the body of the main rear block 60. A valve cover plate 70 secures the spring 72 in place inside the main rear block 60 such that, when the charge valve handle 26 is lifted, the spring 68 is compressed against the cover plate 70, allowing the charge valve handle 26 to return to its resting position once released. The above described parts can be secured using metal screws 73, washers/o-rings 75 as shown, or other known equivalents. A tee-shaped hose fitting 66 extends from the inside wall of rear block 60, and outside of the core 16 (see FIG. 1) of the device when assembled. The hose fitting 66 receives compressed fluid (e.g., air) from one or more supply containers such as compressed gas tanks 270 (see FIG. 3) and permits it to travel through main rear block 60 or front block sub-assembly, depending upon the embodiment of the present invention and whether the device is being loaded with compressed fluid or re-set, as will be described more completely hereinafter. It will be appreciated that, while the tank 270 is shown secured to the core 200 of the present invention, it is conceivable that a separate detached fluid supply container can be employed. For example, the fluid supply can come from a large, vehicle-supported tank brought to the site where the device of the present invention will be used.

A rear bulkhead block 80 extends substantially perpendicularly and inwardly of the main rear block 60, and supports the sear arm sub-assembly 41 of the present invention. In one embodiment of the present invention, the rear bulkhead block 80 includes a substantially cylindrical base portion 82 and two stanchion arms 83, 84. The base portion 82 can be secured to the main rear block 60 using one or more socket head cap screws 77, for example. Each of the stanchion arms 83, 84 includes an opening 85 extending laterally therethrough for receiving a shoulder screw 86 or similar mechanical element. The stanchion arms 83, 84 also define a passageway 87 into which a sear arm 88 can be received. The sear arm 88 includes a bore hole 89 through its rearward portion 90 for receiving the shoulder screw 86, which allows the sear arm 88 to pivot upwardly and downwardly within the passageway 87 between the two stanchion arms 83, 84. An o-ring member 92 is provided in a groove 94 around the base portion 82 of the rear bulkhead block 80 in order to assist in proper sealing of the unit when assembled.

A sear spring block 95 is secured to the rear bulkhead block 80, and retains one end 97 of a sear spring 96. The sear spring 96 extends diagonally upwardly through a throughbore 99 in the sear pin 88, and is secured at its other end 98 to a spring pin 100. The spring pin 100 is retained within the sear pin 88 by means of openings 91 extending into the sear pin body on both sides of the throughbore 99. In one embodiment of the present invention, the sear pin 88 comprises a back end 90 that is substantially rounded so as to permit smooth pivoting during operation, a middle portion having the diagonal throughbore 99 and spring pin holes 91 below a shoulder portion 81 that extends outwardly of the middle portion, and a front end portion 102 having a latch edge 104 extending substantially downwardly when in the resting position, whereby the latch edge 104 and the shoulder portion 81 form a piston-receiving opening 105 therebetween.

Figure 4:
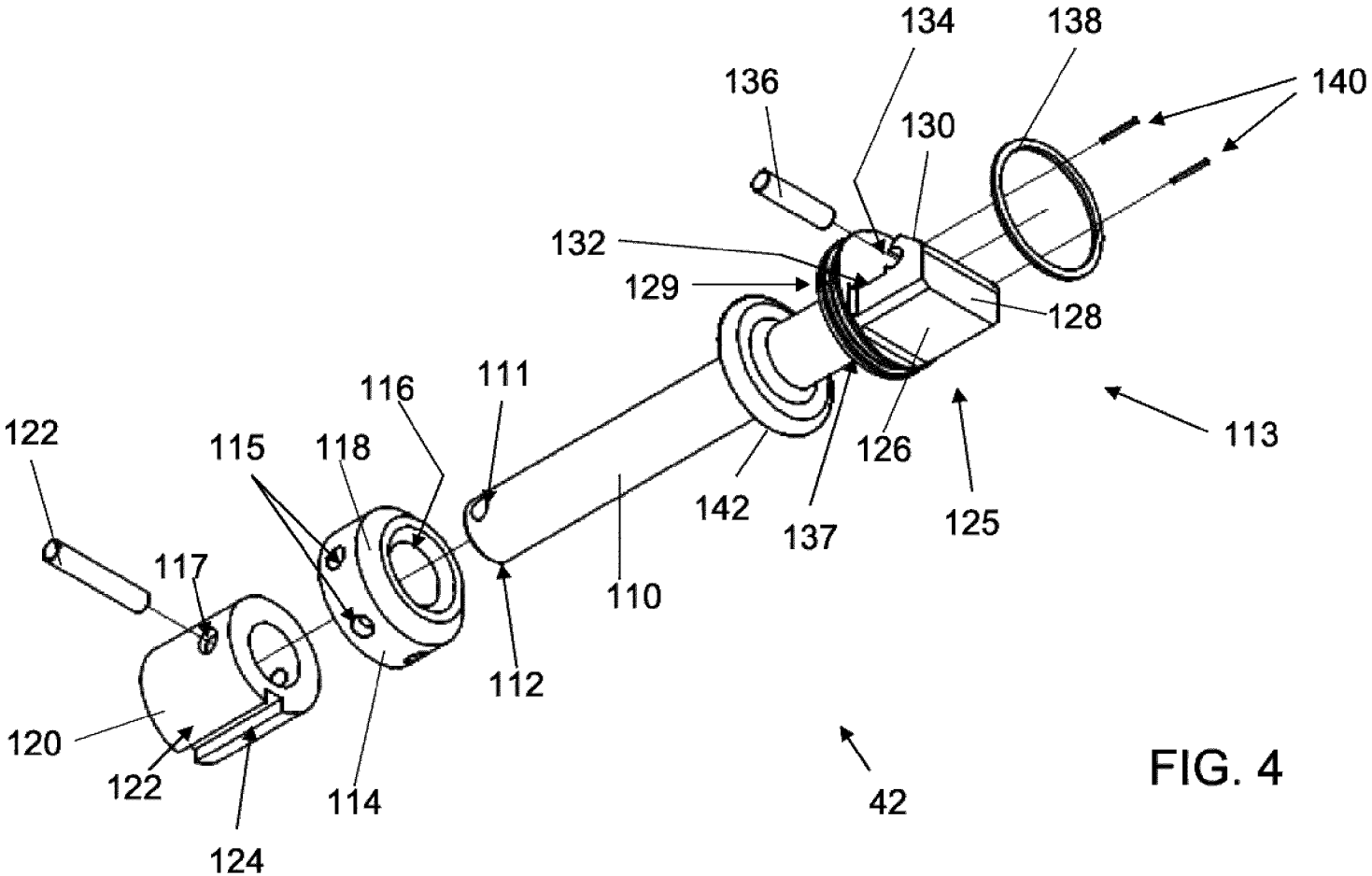
FIG. 4 is an exploded perspective view of a piston sub-assembly of one embodiment of the present invention.

As shown in FIG. 4, the piston sub-assembly 42 of the present invention includes, in one embodiment, a piston main body 110 having a pin hole 111 through the front facing end 112 thereof. The front facing end 112 is extendable through a front bulkhead block 114 which is also provided with pin holes 115 extending therethrough. The front bulkhead block 114 has an axial opening 116 for receiving the piston 110 and an impact cap 120, and further has a shoulder portion 118 that provides a surface on the interior of the block 114 against which the impact cap 120 can rest when in the operative position. A pin 122 is extendable through a pin hole 115 in the block 114, an opening 117 in the impact cap 120, and pin hole 111 in the piston in order to securely retain the piston together with the block 114 and the impact cap 120. The impact cap 120 is further provided with an outer surface 122 having and/or defining an axially extending groove 124 therein for receiving an impact cap guide block, as described hereinafter in more detail.

On the rear facing end 113 of the piston sub-assembly 42, the piston member 110 includes a head 125 having a substantially planar bottom surface 126, a substantially planar back surface 128 and a latch edge 130 extending away from the bottom surface 126. It will be appreciated that the latch edge 130 can extend in a variety of directions away from the bottom surface 126 of the piston head 125 while still meeting the performance standards of the present invention. In FIG. 4, however, latch edge 130 is shown extending somewhat angularly away from the bottom surface 126. The latch edge 130 and the top interior surface 132 of the piston head 125 form a cavity 134 for receiving a pin member 136. The pin member 136 and the latch edge 130 further provide a cooperating latching element for the latch edge 104 of the sear arm member 88 of the sear arm sub-assembly 41 described above. The latch edge 130 of the piston sub-assembly and the latch edge 104 of the sear arm member 88 permit the piston head and the sear arm to engage one another in substantially locked relation. Further, the pin member 136 assists in providing fluid mechanical operation for these parts during firing and re-setting of the device. Spring pins 140 can also be provided to retain the pin member 136 in position.

An o-ring member 138 is provided in a groove 137 around the base portion 129 of the piston head 125 in order to assist in proper sealing of the unit when assembled. An axial guide member 142 is also spaced apart and positioned axially inwardly of the piston head and this element 142 provides for appropriate guiding and stabilization of the piston 110 as it is moved through the inner chamber of the device 10 during operation. In one embodiment of the present invention, the guide member 142 is positioned approximately two to three inches away from the piston head base 129.

In one embodiment of the present invention, the piston member 110 is made of stainless steel.

Figure 5:
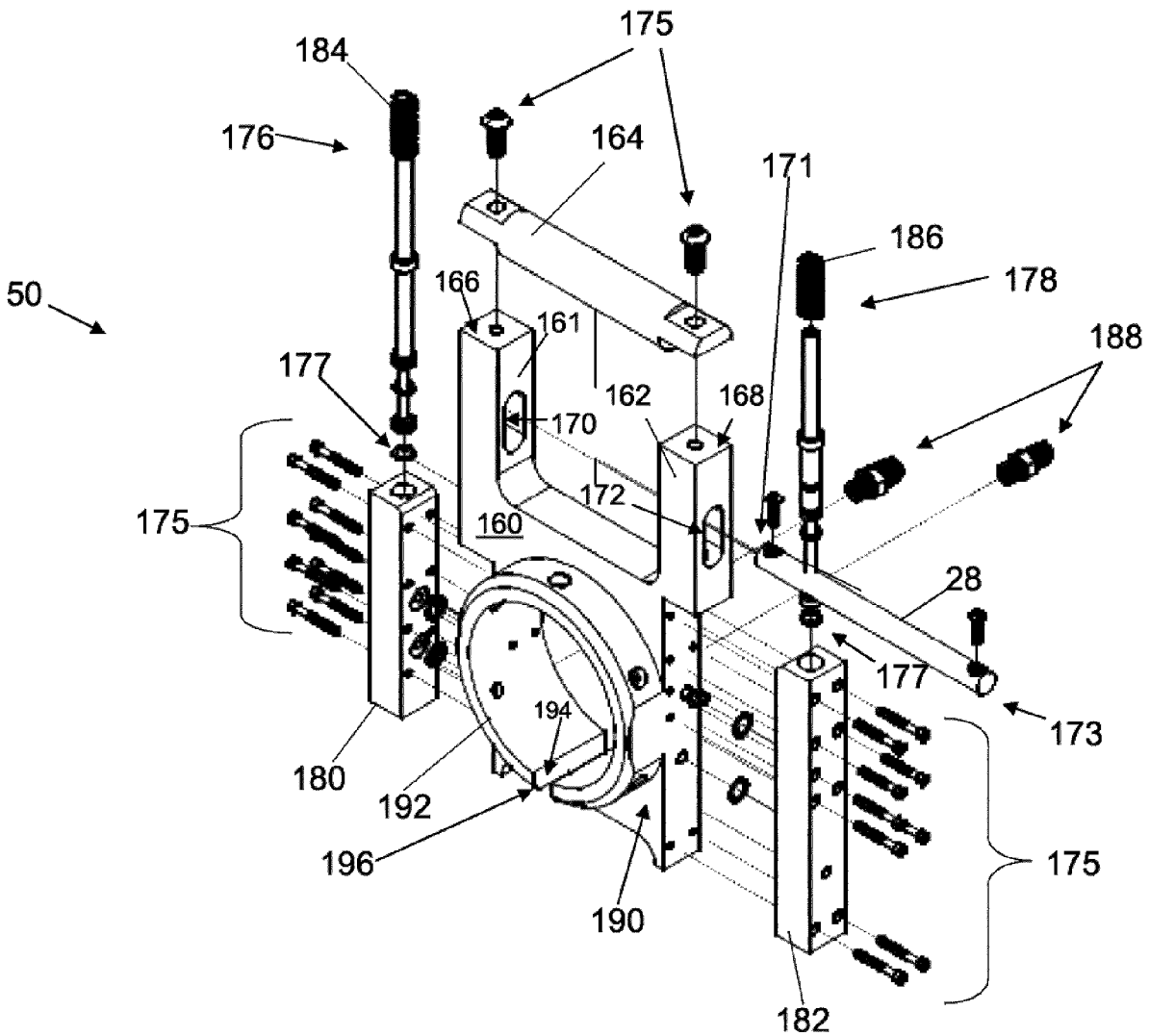
FIG. 5 is an exploded perspective view of a front block sub-assembly of one embodiment of the present invention.

As shown in FIG. 5, the front block sub-assembly 50 includes main front block 160, which has two arms 161 and 162 extending therefrom. Operator handle 164 is secured at the top edges 166, 168, respectively, of the two arms 161, 162. Each of the two arms 161, 162 also includes a respective opening 170, 172 extending laterally therethrough for receiving a respective end 171, 173 of a charge valve handle 28, so as to permit the charge valve handle ends 171, 173 to move vertically within a limited range. The charge valve handle 28 engages a pair of spring-loaded charge valve pistons 176 and 178, wherein the pistons extend into an exhaust valve block 180 and a return valve block 182, respectively. The valve blocks 180, 182 are secured underneath respective arms 161, 162 such that, when the charge valve handle 28 is lifted, respective spring members 184, 186 are compressed against the bottoms of the arms, allowing the charge valve handle 174 to return to its resting position once released. The above described parts can be secured using metal screws 175, washers/o-rings 177 as shown, or other known equivalents. Further, hose fittings 188 can be provided so as to insulate and protect the passage of fluids during operation of the present invention, as will be described more completely hereafter. The return valve block member and the exhaust valve block member each have a body defining one or more internal fluid passageways therein.

On the front facing edge 190 of the front block 160, a substantially cylindrical guide member 192 is provided for receiving the core shell member 200 of the present invention. The guide member 192 extends axially outwardly of the front facing edge 190 of the front block, toward the front end 12 of the device 10. As shown in the embodiment of the present invention in FIG. 5, the guide member 192 does not form a complete cylinder but rather includes interior edges 194 that form a gap 196 substantially at the bottom of the member 192. This gap 196 permits the impact cap guide block of the present invention to pass through as described more completely hereafter.

Figure 7:
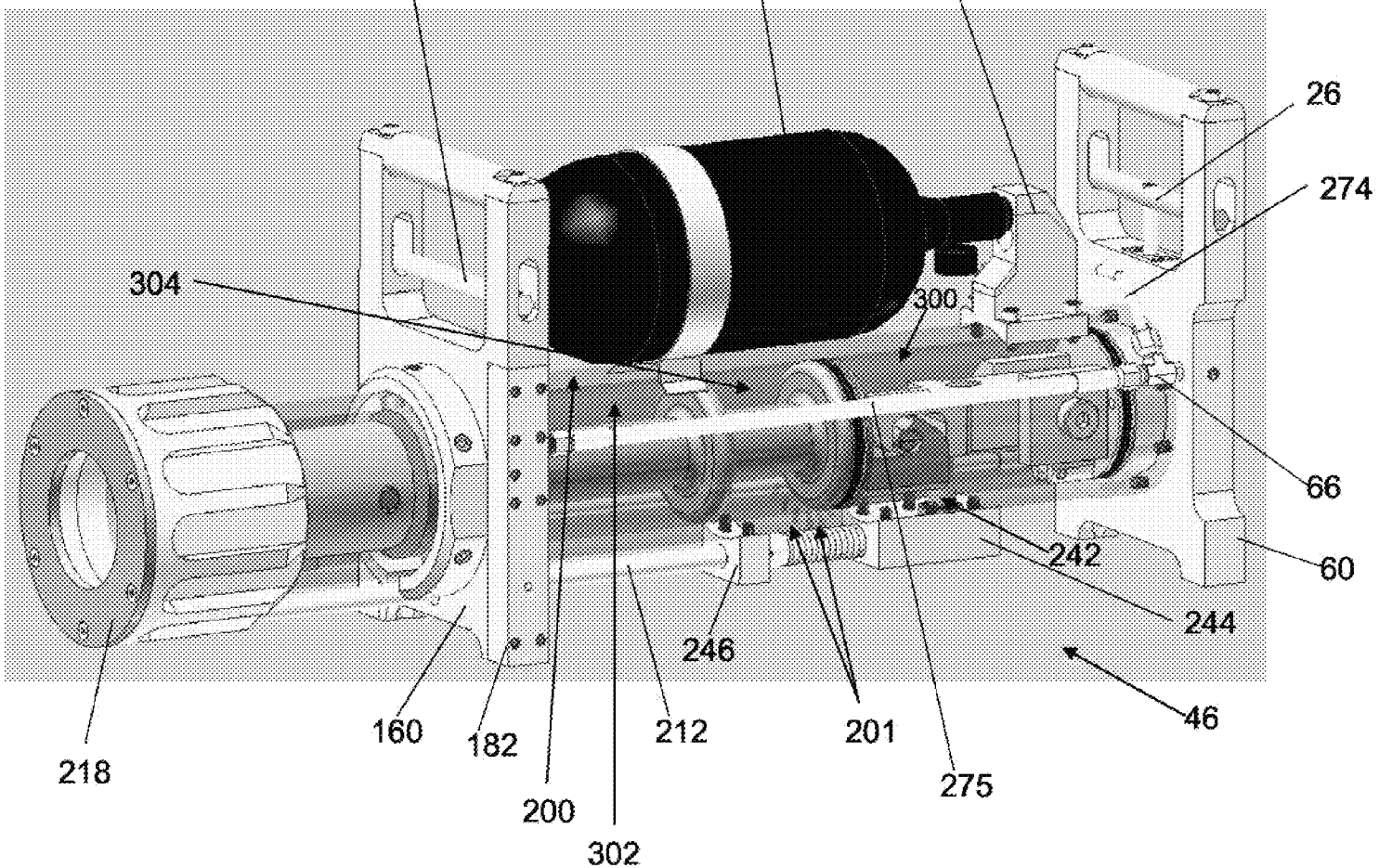
FIG. 7 is a perspective view of one embodiment of the device of the present invention, with a portion of the core shell member not shown so as to reveal internal components of the embodiment of the present invention.

As shown in FIG. 2, the core sub-assembly 48 of the present invention comprises core shell member 200, which can be provided with openings so as to receive attachments such as portions of the pressurization sub-assembly 44. In one embodiment of the present invention, as shown in FIG. 7, perpendicular openings 201 are provided through the surface of the core shell member 200 to assist with the release of fluid and/or depressurization during the re-setting of the device of the present invention. As further shown in FIG. 2, the rear block 60 is secured to the core shell member 200 in a substantially perpendicular relationship to the longitudinal axis A of the core shell member 200, and the sear arm 88 extends substantially along the longitudinal axis A of the core shell member 200.

Figures 6, 9:
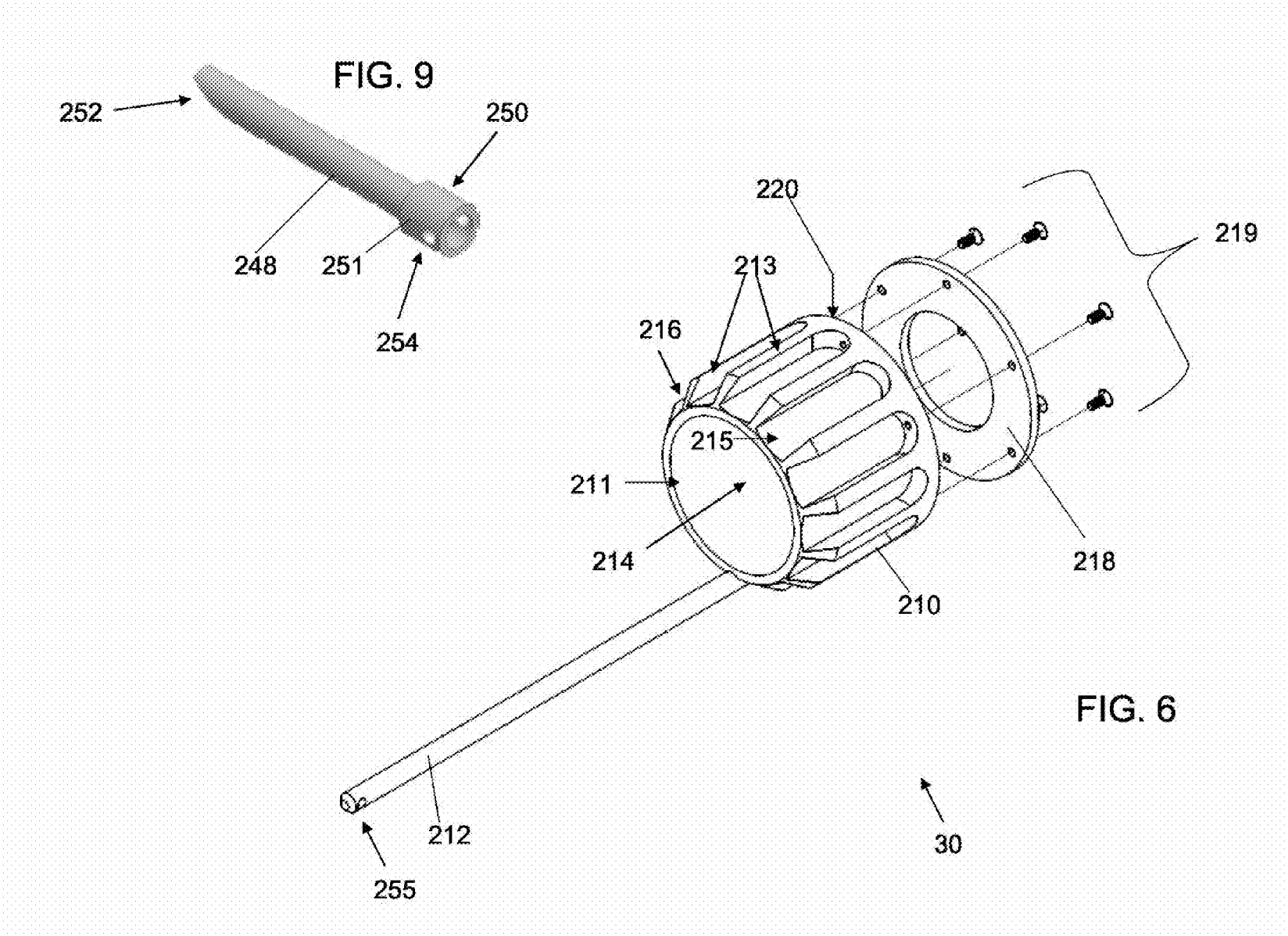
FIG. 6 is an exploded perspective view of a striker sub-assembly of one embodiment of the present invention.
FIG. 9 is a perspective view of a sear trigger rod in accordance with one embodiment of the present invention.

As shown in FIG. 6, the striker sub-assembly 30 of the present invention includes a striker head block 210 with a striker rod 212 attached thereto and extending coaxially therewith. The striker head block 210 can be substantially cylindrical in shape, and optionally provided with ridges 213 on its outer surface 216 that form grooves 215 therebetween. The striker head block 210 can be provided with a smooth cylindrical interior surface 211 that forms a cylindrical passageway 214 through which the impact cap 120 of the piston sub-assembly 42 can move. The striker rod 212 can extend from an opening provided in the striker head block 210 between the inner 211 and outer 216 surfaces. In one embodiment of the present invention, the striker rod 212 is approximately fourteen to fifteen inches in length, and the striker head block and striker rod are made of aluminum. A striker plate 218 is also provided on the front facing end 220 of the striker head block 210. In one embodiment of the present invention, the striker plate 218 is formed of stainless steel and provides a solid striking surface for striking a door or barricade. The striker plate 218 can be secured using metal screws 219, for example. The striker sub-assembly is securable to the core shell member 200 such that the head can travel backwards over the core shell member 200 without contacting the elements of the front block sub-assembly 50. Unless otherwise described herein, the methods of securing various parts together to provide the device of the present invention can be via screws, pins, welding, frictional engagement or other similar known method. As shown in FIG. 7, the striker rod 212 extends outside of the outer surface of the core shell member 200 and back towards the rear block 60. Thus, in this embodiment of the present invention, the striker rod 212 does not extend axially beyond the striker plate 218.

As shown in FIG. 2, the impact cap guide block 230 is securable within the core shell member 200 and is positionable within the gap 196 of guide member 192 in front block 160. The impact cap guide block 230 further extends into the opening or slot 124 of the impact cap 120.

Figure 8:
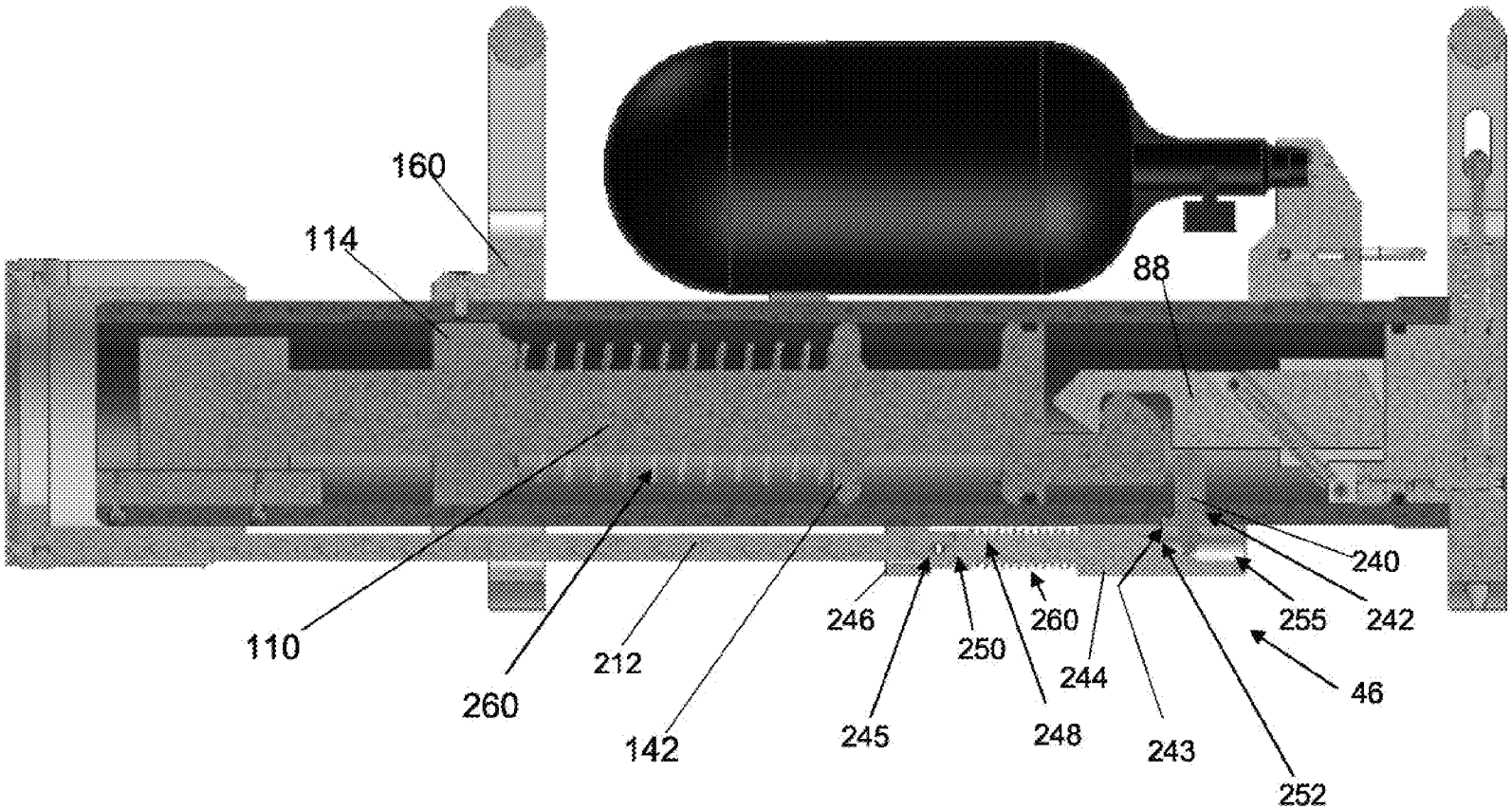
FIG. 8 is a right side sectional view of one embodiment of the present invention employing a spring re-set configuration.

As shown in FIGS. 7 through 9, the sear trigger sub-assembly 46 includes a sear trigger pin 240, a sear trigger sleeve 242, a rear sear trigger block 244, a front sear trigger guide block 246 and a sear trigger rod 248. The striker arm 212 of the striker sub-assembly extends through the front sear trigger guide block 246, which is mounted to the underside of the core shell member 200 such as by screws, bolts or the like. The tip 245 of the striker arm 212 engages the sear trigger rod 248. The sear trigger rod 248 includes a head portion 250 and an angled foot portion 252. In one embodiment of the present invention, the sear trigger rod head portion 250 is substantially hollow with an outer wall 251 that includes a bore hole 254 on opposite sides. The striker arm 212 can be of sufficient diameter as to extend into the hollow portion of the sear trigger rod head portion 250, and the striker arm can also be provided with a bore hole 255 therethrough (see FIG. 6), wherein the borehole 255 of the striker arm 212 can mate with the bore holes 254 of the sear trigger rod head portion 250. In this way, a pin (not shown) or similar device can be inserted through the holes in the sear trigger rod head portion and the striker arm in order to retain them together in operative fit.

The angled foot portion 252 of the sear trigger rod 248 can extend into a horizontal opening 255 in the rear sear trigger block 244 so as to be either just in contact with, or just out of contact with, the sear trigger pin 240 when the device is at rest. The rear sear trigger block 244 can also be formed with a series of substantially vertical openings to enable the block 244 to be secured to the core shell member 200 through screws, for example. The rear sear trigger block 244 is also formed with horizontal opening 255 to receive the sear trigger rod 248 as well as a vertical opening extending from the horizontal opening and upward toward the core shell member so as to receive the sear trigger pin 240. The sear trigger pin 240 rests within a sear trigger sleeve 242, which is a hollow substantially cylindrical member having a cap or head portion 243 that can be positioned within a substantially cylindrical indentation formed in the upper surface of the rear sear trigger block 244. The trigger sleeve 242 houses the pin 240 so as to channel its motion vertically during operation of the present invention. A compression spring 260 is placed around the sear trigger rod 248 and positioned between the front sear trigger guide block 246 and the rear sear trigger block 244. In this way, when the striker rod 212 is propelled towards the sear trigger rod 248, the substantially horizontal force pushes the sear trigger rod 248 such that its angled foot portion 252 contacts the sear trigger pin 240, causing a translation into vertical force of the pin upward and against the sear trigger arm 88, as described more completely hereafter.

As shown in FIGS. 1, 2 and 7, the pressurization sub-assembly 44 of the present invention can operate using one or more fluid supply sources, such as compressed air tank(s) 270 secured atop the core shell member 200. One or more bottle mount blocks 272 can be provided adjacent the fluid supply source(s) 270 to facilitate transfer of compressed fluid (e.g., air). In the embodiment of the invention shown in FIGS. 1 and 7, there is a single air tank 270 and bottle mount block 272. The bottle mount block 272 is provided with internal openings or passageways in order to channel compressed fluid from the bottle 270 through a hose 274 and through the tee fitting 66 (see FIG. 7). In one embodiment of the present invention, the fluid in the supply source is compressed air that is regulated at five hundred pounds per square inch (500 psi). When the rear charge valve handle 26 is lifted in this embodiment, the compressed air is permitted to flow through fluid channels and/or passageways in the rear main block 60 and into a charging chamber indicated at 300 in FIG. 7. When the front charge valve handle 28 is lifted, the compressed air is permitted to flow through channels in the return valve block 182 of the front main block 160 and into a return pressurization chamber 302, also illustrated in FIG. 7. A third enclosed chamber 304 exists between axial guide member 142 and base portion 129 of piston head 125 (see FIG. 4); however, this chamber is not pressurized and does not substantially affect movement of the piston 110 in either direction during the firing or re-setting of the device of the present invention.

The implementation of a return valve block 182 and an exhaust valve block 180 in association with front main block 160 provides enhanced fluid pressurization management for the present invention. When the front charge valve handle 28 is at rest and not lifted, fluid lines are open through the exhaust valve block 180. This assists in venting fluid outside of the core 200 during firing of the piston described below. When the front charge valve handle 28 is lifted, the fluid lines through the exhaust valve block 180 are closed and the fluid lines through the return valve block are opened, thereby permitting pressurized fluid from hose 275 to flow into chamber 302, which pushes the piston back to its pre-firing location, engaged with the sear pin. It will be appreciated that the term hose used in connection with items 274 and 275 can refer to a suitable rubber hose for permitting fluid flow according to the present invention, and can also refer to a tube or other conduit permitting fluid passage. Also, while hoses 274 and 275 are shown mounted externally of the core member 200, the present invention contemplates that the fluid passageways and/or distribution lines may be positioned inside of the core member in one embodiment of the present invention. In such an embodiment, there may be no hoses and one or more conduits or recessed cavities can be formed as part of the interior of the core member instead, in order to permit fluid flow. The various elements for permitting fluid flow according to the different embodiments of the present invention can be referred to as fluid carrier elements.

It will be appreciated that the external mounting of the tank 270 and fluid carrier elements 274, 275 and fittings 66 permit simple interchanging of tanks, while reducing the chance for holes or crimps in the lines to affect internal fluid pressurization and therefore performance of the device.

In an alternative embodiment of the present invention, as shown in FIG. 8, no external hose 275 is provided, and there is no need for return valve block 182 and exhaust valve block 180 with associated fluid passageways. Instead, a large extension spring 260 is provided around the piston 110 such that, when the piston is fired, the extension spring compresses and exerts force back against the piston using the front bulkhead block 114 as a support surface. As shown in FIG. 8, the spring 260 is thus compressed between front bulkhead block 114 and axial guide member 142 for piston 110.

Operation

For purposes of operational discussion, air will be employed as the pressurized fluid. In operation, the user charges the device by lifting the rear operating handle 26, which allows regulated air to "static out" into the device's back chamber or charging cavity 300 via hose 274, tee fitting 66 and passageways within rear main block 60. Next, the device is swung into the desired target object such that the striker plate 218 hits the object and causes the striker head 210 and rod 212 to move backward towards the rear of the device. As the striker rod 212 moves backward, it pushes the spring-loaded sear trigger rod 248 back into the sear trigger pin 240. The sear trigger pin 240 then moves upwardly and pushes the spring-loaded sear trigger arm 88 upward so as to release the piston rod 110. The charged air propels the piston and the impact cap with extremely high velocity and striking force into the target object. As air pushes the piston forward, some of the air in the return chamber 302 can escape laterally via the exhaust valve block passageways described above, in the embodiment of the present invention incorporating the compressed air re-setting assembly. Further, air from the charging chamber 300 can escape via openings 201 in the core 200, as illustrated in FIG. 7 and described above. This assists in depressurizing the charging chamber once the piston is fired, which thereby results in needing less pressure in the return chamber to re-set the device.

Extension of the piston and impact head can conclude motion well past the striker plate. In one embodiment of the present invention, the design permits travel of the impact head to a position approximately three to four inches past the striker plate. The resulting force should nearly always be sufficient to break a door through the door jamb and therefore permit entry into a building structure. In the event that the first shot does not sufficiently force open the target object, one embodiment of the present invention includes a rapid manual re-setting system, whereby the user can lift the front operating handle, which both releases forced air on the front side of the piston via return valve block 182 and exhausts air from the previously charged chamber on the rear side of the piston. This re-setting is concluded as the piston head latch element engages the sear arm head latch element. The sear arm head will have returned to the substantially horizontal resting position due to the spring member pulling the arm back downward after it had been lifted by the sear trigger pin. The sear trigger pin 240 would similarly have been re-set downward and into the rear sear trigger block 244 by the same spring. The sear trigger rod 248 will have been re-set as well by the compression spring in the sear trigger sub-assembly 46.

It will be appreciated that the lifting of the front operating handle can also be used to render the device "safe" or unloaded after it has been charged but not yet swung. In the embodiment of the present invention as illustrated in FIG. 8, there is no operating handle on the front main block; rather, the compression spring 260 acts to automatically re-set the piston and sear arm in latched position.

In one embodiment of the present invention, many of the parts are cast in aluminum, thereby reducing the overall weight of the device and providing for rapid re-usability without deteriorating effect.

In one embodiment of the present invention, the device can be assembled according to a preferred method, comprising: providing the hollow core shell member, with the shell member having a first end, a second end and an outer surface; attaching a front bulkhead sub-assembly to the outer surface of the core shell member at a position near the first end; securing a piston sub-assembly inside of the core shell member, wherein the piston sub-assembly includes a piston having a head portion; securing a sear arm sub-assembly to a rear bulkhead sub-assembly, with the sear arm sub-assembly including a sear arm having a head portion; securing the rear bulkhead sub-assembly to the core shell member, such that the piston head portion and sear arm head portion are capable of engaging one another in substantially locked relation; and securing a sear trigger assembly to the core shell member.

The above method can further include the step of securing a striker sub-assembly to the first end of the core shell member. The above method can further include providing the sear trigger assembly with a sear trigger rod having an angled foot portion. The above method can further include providing the sear trigger assembly with a rear sear trigger block for receiving a sear trigger rod in a substantially horizontal position and a sear trigger pin in a substantially vertical position. The above method can further include providing the sear trigger assembly with a spring loaded sear trigger rod. The above method can further include providing the sear trigger assembly with a sear trigger pin extending from a position outside of the outer surface of the core shell member to a position inside of the core shell member. The above method can further include providing a pressurization sub-assembly that includes providing fluid passageways through the rear main block. The above method can further include providing a pressurization sub-assembly that includes providing fluid passageways through the rear main block and through valve blocks secured to the front main block. The above method can further include providing a re-set mechanism comprising a compression spring secured between a guide member 192 of the front main block and an axial guide member 142 for piston 110.

It should be understood that the foregoing description and examples are only illustrative of the present invention; the optimum dimensional relationships for the parts of the invention, including variations in size, materials, shape, form, function and the manner of operation, assembly and use, are deemed readily apparent to one skilled in the art, and all equivalent relationships to those illustrated in the drawings and described in the specification are intended to be encompassed by the present invention. Thus, various alternatives and modifications can be devised by those skilled in the art without departing from the invention. Accordingly, the present invention is intended to embrace all such alternatives, modifications, and variances that fall within the scope of the appended claims.

The invention claimed is:

1. An impact device, comprising:

a core shell member having a first end and an outer surface;

a piston sub-assembly housed within the core shell member, and including a piston having a head portion;

a sear arm sub-assembly housed within the core shell member, with the sear arm sub-assembly including a sear arm having a head portion, wherein the piston head portion and sear arm head portion are capable of being fixedly held together;

a striker sub-assembly secured at the first end of the core shell member; and a sear trigger assembly secured to the core shell member.

2. The impact device of claim 1 wherein the sear trigger assembly includes a sear trigger rod having an angled foot portion.

3. The impact device of claim 1 wherein the sear trigger assembly includes a rear sear trigger block for receiving a sear trigger rod in a substantially horizontal position and for receiving a sear trigger pin in a substantially vertical position.

4. The impact device of claim 1 wherein the sear trigger assembly includes a spring loaded sear trigger rod.

5. The impact device of claim 1 wherein the sear trigger assembly includes a sear trigger pin extending from a position outside of the outer surface of the core shell member to a position inside of the core shell member.

6. The impact device of claim 1 wherein the sear arm assembly includes a sear arm mounted to a rear block, wherein the rear block is secured to the core shell member in a substantially perpendicular relationship to the longitudinal axis of the core shell member, and wherein the sear arm extends substantially along the longitudinal axis of the core shell member.

7. The impact device of claim 6 wherein the sear arm is spring loaded by a spring member that extends substantially diagonally from the sear arm to a sear arm spring block that is mounted to the rear block.

8. The impact device of claim 1 wherein the striker assembly includes a striker plate and a striker rod, wherein the striker rod extends outside of the outer surface of the core shell member but not axially beyond the striker plate.

9. The impact device of claim 1 further including a rear operating handle and a front operating handle, wherein the device can be charged using the rear operating handle and re-set using the front operating handle.

10. The impact device of claim 1 wherein the piston sub-assembly further includes a front bulkhead block and an axial guide member secured around the piston, and wherein the impact device further includes an internal re-setting extension spring positioned around the piston between the front bulkhead block and the axial guide member.

11. The impact device of claim 1 further including a pressurization sub-assembly that comprises a source of compressed fluid external to the core shell member.

12. The impact device of claim 11 wherein the pressurization sub-assembly further comprises at least one fluid carrier element extending from a bottle mount block to a front handle.

13. A method of constructing a hand-held impact device, comprising:

providing a hollow core shell member having a first end, a second end and an outer surface;

attaching a front bulkhead sub-assembly to the outer surface of the core shell member at a position near the first end;

securing a piston sub-assembly inside of the core shell member, wherein the piston sub-assembly includes a piston having a head portion;

securing a sear arm sub-assembly to a rear bulkhead sub-assembly, with the sear arm sub-assembly including a sear arm having a head portion;

securing the rear bulkhead sub-assembly to the core shell member, such that the piston head portion and sear arm head portion are capable of being fixedly held together; and securing a sear trigger assembly to the core shell member.

14. The method of claim 13 including the further step of securing a striker sub-assembly to the first end of the core shell member.

15. The method of claim 13 wherein the step of securing a sear trigger assembly to the core shell member outer surface includes providing the sear trigger assembly with a sear trigger rod having an angled foot portion.

16. The method of claim 13 wherein the step of securing a sear trigger assembly to the core shell member outer surface includes providing the sear trigger assembly with a rear sear trigger block for receiving a sear trigger rod in a substantially horizontal position and a sear trigger pin in a substantially vertical position.

17. The method of claim 13 wherein the step of securing a sear trigger assembly to the core shell member outer surface includes providing the sear trigger assembly with a spring loaded sear trigger rod.

18. The method of claim 13 wherein the step of securing a sear trigger assembly to the core shell member outer surface includes providing the sear trigger assembly with a sear trigger pin extending from a position outside of the outer surface of the core shell member to a position inside of the core shell member.

* * * * *